US008733106B2

(12) United States Patent
Barker et al.

(10) Patent No.: US 8,733,106 B2
(45) Date of Patent: May 27, 2014

(54) FUEL INJECTOR AND SUPPORT PLATE

(75) Inventors: Carl Robert Barker, Greenville, SC (US); Thomas Edward Johnson, Greer, SC (US); Jonathan Dwight Berry, Greenville, SC (US)

(73) Assignee: General Electric Company, Schenectady, NY (US)

( * ) Notice: Subject to any disclaimer, the term of this patent is extended or adjusted under 35 U.S.C. 154(b) by 329 days.

(21) Appl. No.: 13/099,853

(22) Filed: May 3, 2011

(65) Prior Publication Data

US 2012/0279223 A1 Nov. 8, 2012

(51) Int. Cl.
*F02C 1/00* (2006.01)
*F02G 3/00* (2006.01)

(52) U.S. Cl.
USPC ..... 60/747; 60/737; 60/738; 60/740; 60/739; 60/772; 60/776

(58) Field of Classification Search
USPC ..... 60/737–748, 752–760, 772
See application file for complete search history.

(56) References Cited

U.S. PATENT DOCUMENTS

| | | | | |
|---|---|---|---|---|
| 5,117,624 | A | 6/1992 | Roberts, Jr. et al. | |
| 5,901,555 | A * | 5/1999 | Mandai et al. | 60/747 |
| 6,672,073 | B2 * | 1/2004 | Wiebe | 60/796 |
| 7,080,515 | B2 * | 7/2006 | Wasif et al. | 60/737 |
| 7,137,256 | B1 * | 11/2006 | Stuttaford et al. | 60/773 |
| 2004/0050057 | A1 * | 3/2004 | Bland et al. | 60/737 |
| 2009/0188255 | A1 * | 7/2009 | Green et al. | 60/737 |
| 2009/0223228 | A1 * | 9/2009 | Romoser | 60/776 |
| 2011/0073684 | A1 | 3/2011 | Johnson et al. | |
| 2011/0239653 | A1 * | 10/2011 | Valeev et al. | 60/740 |
| 2012/0085100 | A1 * | 4/2012 | Hughes et al. | 60/776 |
| 2012/0151932 | A1 * | 6/2012 | Evulet et al. | 60/772 |
| 2012/0167578 | A1 * | 7/2012 | Berry et al. | 60/772 |

* cited by examiner

*Primary Examiner* — Craig Kim
(74) *Attorney, Agent, or Firm* — Armstrong Teasdale LLP

(57) ABSTRACT

An integrated plate is provided for use with a combustor including a casing, a fuel plenum extending circumferentially about the casing, and a fuel nozzle extending axially through the casing. The integrated plate includes a plurality of fuel injection pegs that extend radially between the fuel plenum and the fuel nozzle.

16 Claims, 4 Drawing Sheets

FUEL INJECTOR AND SUPPORT PLATE

BACKGROUND

The present disclosure relates generally to a turbine system and more particularly to a fuel injector that may be used with a turbine system.

At least some known turbine systems include a combustor that channels fuel therethrough and ignite the fuel to create combustion gases. At least some known combustors include a plurality of fuel nozzle assembles that have a low natural frequency. Operating with a low natural frequency, over time, may decrease an operating life and/or efficiency of at least some known combustors.

To facilitate increasing the natural frequency, at least some known fuel nozzle assemblies are coupled to and supported by a base support structure. However, combustors that include additional components, such as a quaternary fuel injection system, are generally space-limited, cluttered, and/or have complex configurations that may increase the likelihood that airflow anomalies may be created within the combustor and, thus, decreasing an operating efficiency of the combustor. Moreover, the costs of designing, fabricating, and/or maintaining such combustors having complex configurations generally is higher than combustors having a simpler design.

BRIEF DESCRIPTION

In one aspect, a method is provided for assembling a combustor for use with a turbine engine. The method includes coupling a fuel plenum circumferentially about an outer casing of the combustor. A fuel nozzle is extended substantially axially through the casing. A plate including a plurality of fuel injection pegs is extended substantially radially between the fuel plenum and the fuel nozzle such that the plate is oriented to channel fuel from the fuel plenum towards the fuel nozzle.

In another aspect, a fuel injector is provided for use with a combustor including a casing, a fuel plenum extending circumferentially about the casing, and a fuel nozzle extending substantially axially through the casing. The fuel injector includes a plate and a plurality of fuel injection pegs coupled to the plate. The fuel injection pegs extend substantially radially between the fuel plenum and the fuel nozzle.

In yet another aspect, a combustor is provided for use with a turbine engine. The combustor includes a casing, a fuel plenum coupled circumferentially about the casing, and fuel nozzle extending substantially axially through the casing, and a fuel injector. The fuel injector includes a plate and a plurality of fuel injection pegs coupled to the plate. The fuel injection pegs extend substantially radially between said fuel plenum and said fuel nozzle.

The features, functions, and advantages that have been discussed can be achieved independently in various embodiments of the present invention or may be combined in yet other embodiments further details of which can be seen with reference to the following description and drawings.

DETAILED DESCRIPTION

The subject matter described herein relates generally to turbine systems and more particularly to an integrated fuel injection system that may be used with turbine systems. In one embodiment, a combustor includes a plate that is integrated with a plurality of fuel injection pegs that extend substantially radially between a fuel plenum extending circumferentially about the combustor and a fuel nozzle extending axially through the combustor. The integrated injection system integrates the quaternary fuel injection function with support function of the fuel nozzles. Additionally, the integrated injection system provides structural support for other components positioned within the combustor, such as, for example, a cap assembly and/or an air baffle.

As used herein, the terms "axial" and "axially" refer to directions and orientations extending substantially parallel to a longitudinal axis of a combustor casing. The terms "radial" and "radially," as used in this disclosure, refer to directions and orientations extending substantially perpendicular to the longitudinal axis of the combustor casing. As used herein, an element or step recited in the singular and proceeded with the word "a" or "an" should be understood as not excluding plural elements or steps unless such exclusion is explicitly recited. Furthermore, references to "one embodiment" of the present invention or the "exemplary embodiment" are not intended to be interpreted as excluding the existence of additional embodiments that also incorporate the recited features.

Figure 1:
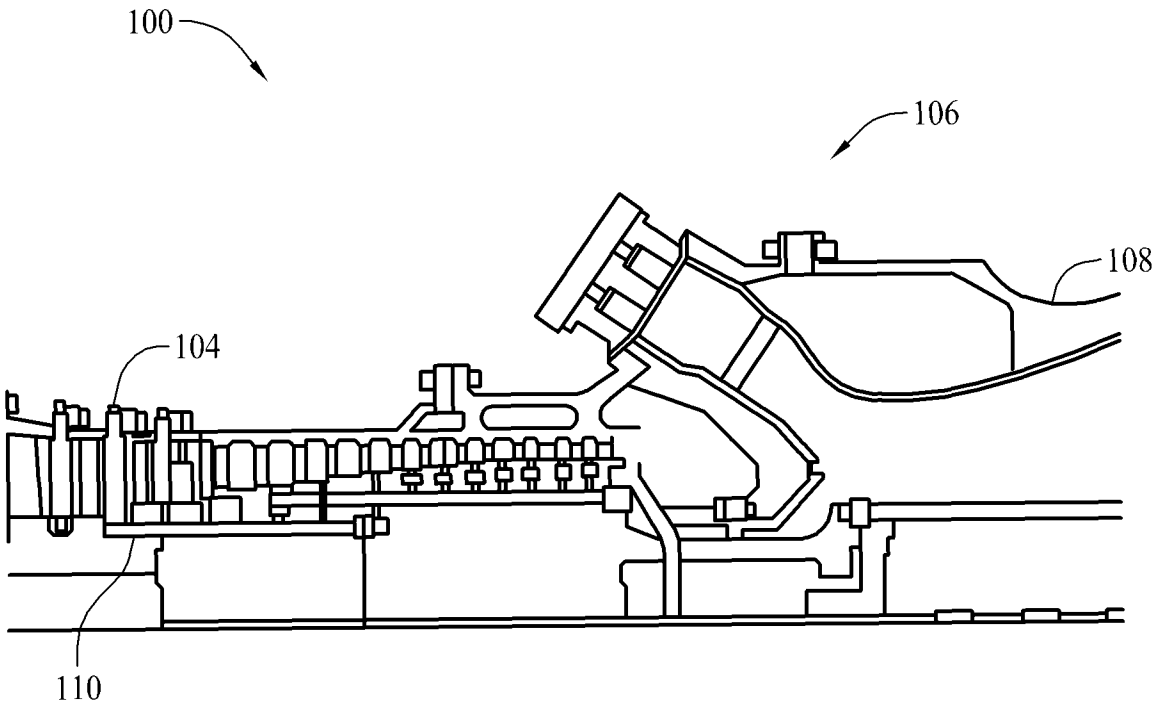
FIG. 1 is a partial cutaway view of an exemplary turbine system.

FIG. 1 is an illustration of an exemplary turbine system 100. In the exemplary embodiment, turbine system 100 includes, coupled in a serial flow arrangement, a compressor 104, a combustor assembly 106, and a turbine 108 that is rotatably coupled to compressor 104 via a rotor shaft 110.

During operation, in the exemplary embodiment, ambient air is channeled through an air inlet (not shown) towards compressor 104. The ambient air is compressed by compressor 104 prior to being directed towards combustor assembly. In the exemplary embodiment, compressed air within combustor assembly 106 is mixed with fuel, and the resulting fuel-air mixture is ignited within combustor assembly 106 to generate combustion gases that are directed towards turbine 108. In the exemplary embodiment, turbine 108 extracts rotational energy from the combustion gases and rotates rotor shaft 110 to drive compressor 104. Moreover, in the exemplary embodiment, turbine system 100 drives a load (not shown), such as a generator, coupled to rotor shaft 110. In the exemplary embodiment, load 112 is downstream of turbine system 100. Alternatively, load 112 may be upstream of turbine system 100.

Figure 2:
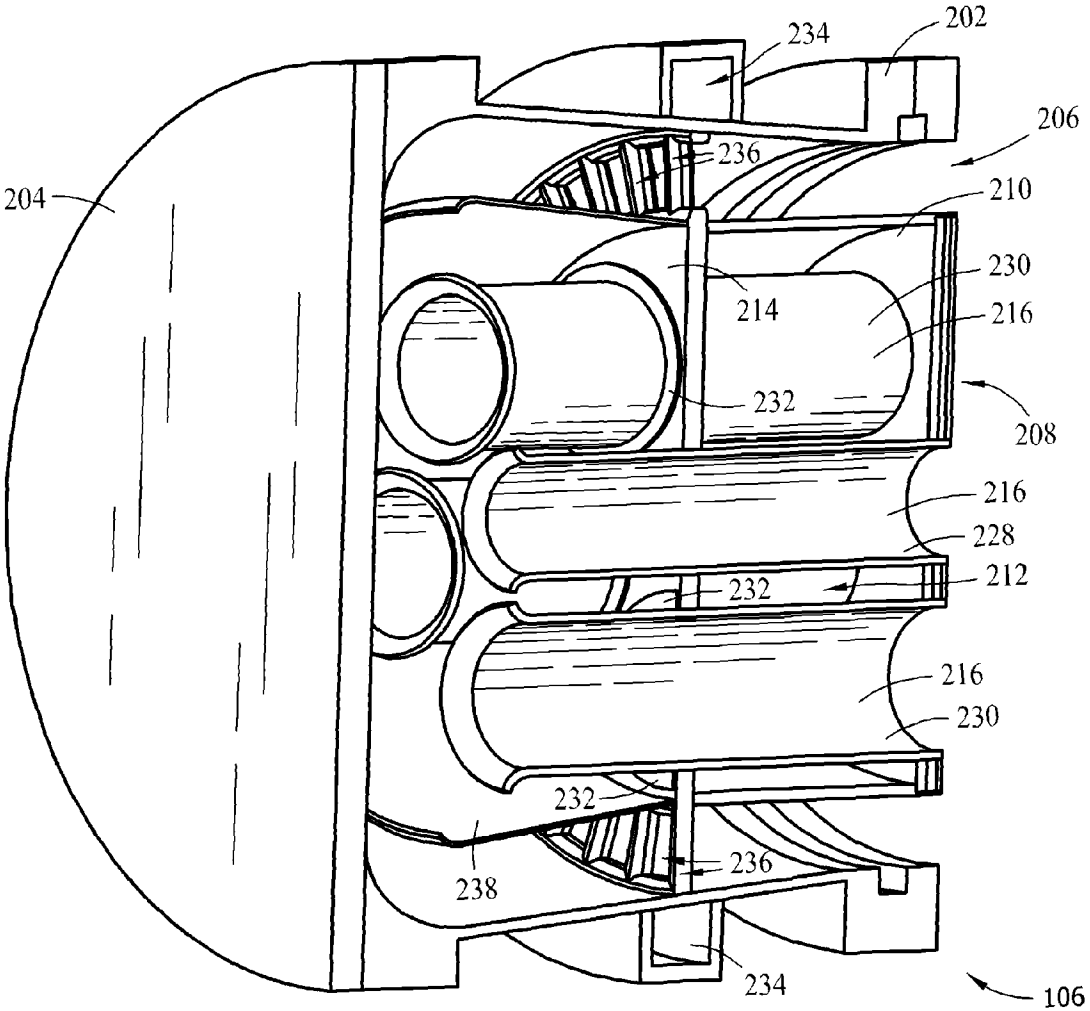
FIG. 2 is a partial cutaway perspective view of an exemplary combustor that may be used with the turbine system shown in FIG. 1.
Figure 3:
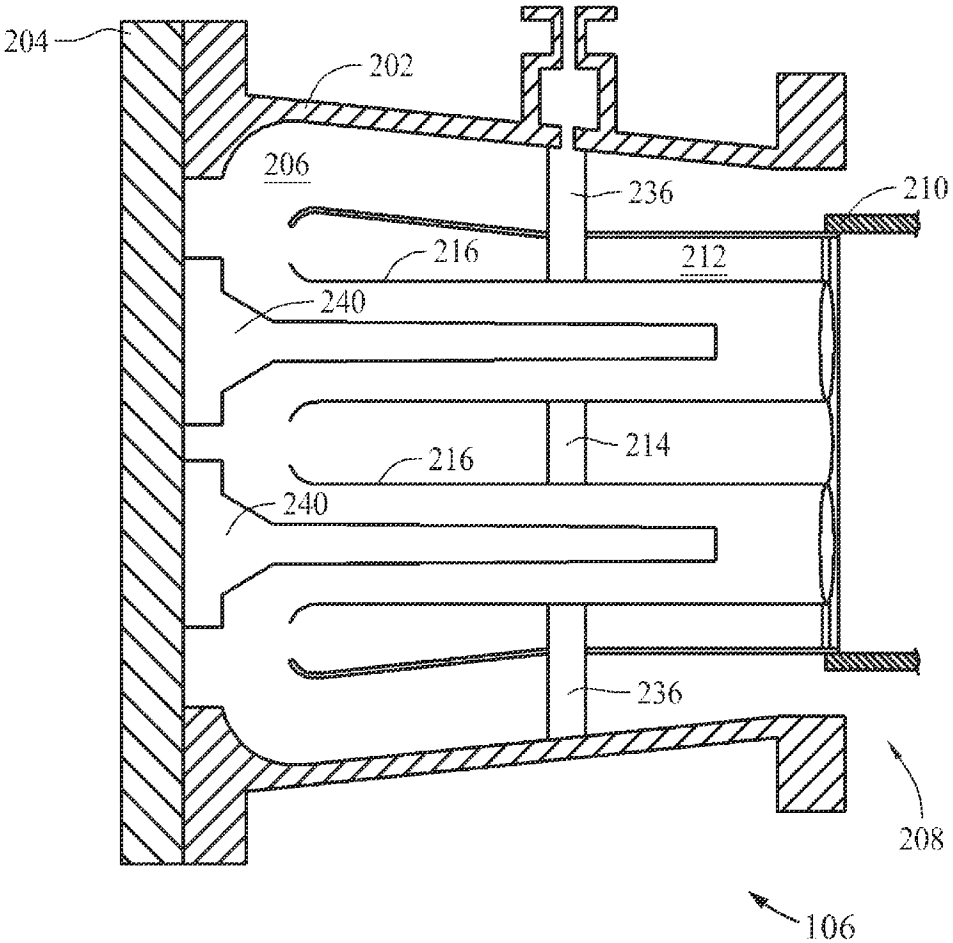
FIG. 3 is a partial cutaway side view of the combustor shown in FIG. 2.

FIGS. 2 and 3 are partial cutaway views of combustor assembly 106. In the exemplary embodiment, combustor assembly 106 includes a substantially cylindrical combustor casing 202 and an end cover 204 that is coupled to combustor casing 202 such that a cavity 206 is defined therein. In the exemplary embodiment, combustor assembly 106 is coupled to a fuel supply (not shown) for supplying fuel through a fuel nozzle and/or a fuel plenum. Fuel may be natural gas, petroleum products, coal, biomass, and/or any other fuel, in solid, liquid, and/or gaseous form that enables turbine system 100 to function as described herein.

In the exemplary embodiment, a cap assembly 208 is positioned within combustor casing 202. More specifically, in the exemplary embodiment, cap assembly 208 is cantileverly supported within combustor casing 202. In the exemplary embodiment, cap assembly 208 includes a cap assembly casing 210 defining a cap assembly cavity 212, a fuel injection system or plate 214 coupled to cap assembly casing 210, and at least one burner tube 216 coupled to plate 214 such that burner tube 216 extends through cavity 212.

In the exemplary embodiment, burner tubes 216 are structurally supported by plate 214. More specifically, in the exemplary embodiment, burner tubes 216 are cantileverly supported by support body 218 at an interface 232 such that burner tubes 216 extend at least partially through cavity 206 in an orientation that is substantially parallel to cap assembly casing 210. As such, in the exemplary embodiment, one end of each burner tube 216 is supported by cap assembly 208, and an opposing end of each burner tube 216 is suspended within cavity 206.

In the exemplary embodiment, a fuel plenum 234 extends circumferentially about an outer surface of combustor casing 202. More specifically, in the exemplary embodiment, fuel plenum 234 has a substantially quadrilateral profile that is configured to channel fuel therethrough. Alternatively, fuel plenum 234 may have any profile that enables fuel plenum 234 to function as described herein.

In the exemplary embodiment, plate 214 includes a plurality of fuel injection pegs 236 that are spaced radially about support body 218. Fuel injection pegs 236 channel fuel from fuel plenum 234 to cavity 206, wherein the fuel is mixed with air channeled upstream between combustor casing 202 and cap assembly 208. The air-fuel mixture is channeled upstream towards an air baffle 238 coupled to plate 214 and into an upstream end of at least one burner tube 216. In the exemplary embodiment, air baffle 238 facilitates regulating airflow within cavity 206 upstream of plate 214.

Moreover, in the exemplary embodiment, fuel is channeled from fuel plenum 234, through fuel injection pegs 236 and plate 214, and into burner tubes 216. As such, in the exemplary embodiment, fuel injection pegs 236 enable additional fuel to be added into the air-fuel mixture channeled through burner tubes 216. In one embodiment, fuel injection pegs 236 includes a first channel (not shown) that directs fuel into cavity 206 and a second channel (not shown) that directs fuel into plate 214 and/or burner tubes 216. In such an embodiment, fuel plenum may be partitioned into a first portion that directs fuel into the first channel and a second portion that directs fuel into the second channel.

As shown in FIG. 3, in the exemplary embodiment, at least one burner tube 216 is oriented such that a fuel nozzle 240 extends through at least a portion of burner tube 216. Alternatively and/or additionally, in the exemplary embodiment, each fuel nozzle 240 channels fuel to a respective burner tube 216, wherein the fuel is mixed with the air-fuel mixture channeled through burner tube 216.

Figure 4:
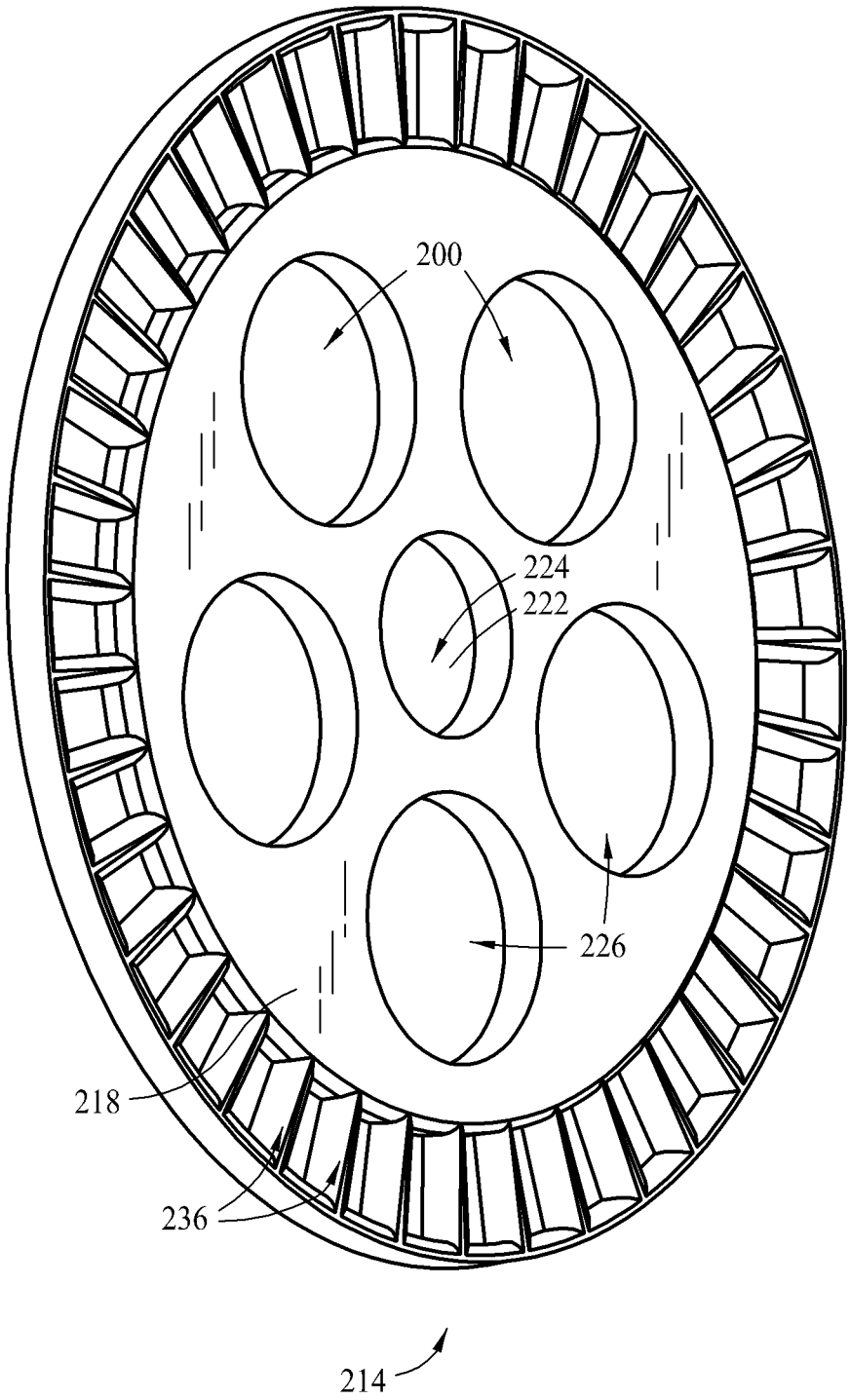
FIG. 4 is a perspective view of a fuel injection system that may be used with the combustor shown in FIG. 2.

FIG. 4 is a perspective view of plate 214. In the exemplary embodiment, plate 214 includes a support body 218 that includes a plurality of openings 200 extending therethrough. Each opening 200 is sized to receive a respective burner tube 216 and/or fuel nozzle 240 therein. More specifically, in the exemplary embodiment, a first opening 222 is defined approximately at a radial center 224 of plate 214, and a plurality of second openings 226 are spaced radially about first opening 222. As such, in the exemplary embodiment, first opening 222 is oriented to enable a first burner tube 228 (shown in FIG. 2) to extend to and/or through radial center 224, and a plurality of second burner tubes 230 (shown in FIG. 2) are spaced in a generally circular array about radial center 224. Alternatively, support body 218 may include any number of openings 200 arranged in any configuration that enables combustor assembly 106 to function as described herein.

During operation, in the exemplary embodiment, airflow is channeled upstream through cavity 206 between combustor casing 202 and cap assembly 208. More specifically, in the exemplary embodiment, the airflow is channeled between adjacent fuel injection pegs 236, where the air is mixed with fuel discharged from fuel injection pegs 236. In the exemplary embodiment, the air-fuel mixture within cavity 206 upstream of fuel injection pegs 236 is lean and, more specifically, below a predetermined flammability limit. The lean air-fuel mixture is channeled through and/or around air baffle 238 and into burner tubes 216, wherein the air-fuel mixture is mixed with additional fuel discharged from fuel nozzles 240. Alternatively or additionally, in the exemplary embodiment, additional fuel may be injected into the air-fuel mixture from fuel plenum 234 through fuel injection pegs 236 and/or plate 214. The resulting air-fuel mixture, which is at or above the predetermined flammability limit, is ignited within a combustion chamber (not shown) downstream from plate 214 and/or burner tubes 216.

The exemplary methods and systems described herein enable streamlining the airflow within the combustor. More specifically, the exemplary methods and systems enable providing a lean prenozzle injection using an integrated or simplified arrangement. Additionally, the exemplary methods and systems may enable a lowest natural frequency of the burner tubes and/or fuel nozzles positioned within the combustor to be increased.

Exemplary embodiments of methods and systems are described and/or illustrated herein in detail. The exemplary systems and methods are not limited to the specific embodiments described herein, but rather, components of each system and/or steps of each method may be utilized independently and separately from other components and/or method steps described herein. Each component and each method step may also be used in combination with other components and/or method steps.

This written description uses examples to disclose certain embodiments of the present invention, including the best mode, and also to enable any person skilled in the art to practice those certain embodiments, including making and using any devices or systems and performing any incorporated methods. The patentable scope of the present invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for assembling a combustor for use with a turbine engine, said method comprising:

coupling a fuel plenum circumferentially about an outer casing of the combustor;

extending a fuel nozzle substantially axially through the casing;

extending a plate including a plurality of fuel injection pegs substantially radially within the casing from the fuel plenum to the fuel nozzle, such that the plate is oriented to channel fuel from the fuel plenum towards the fuel nozzle;

cantileverly supporting the fuel nozzle with the plate; and wherein the plurality of fuel injection pegs extend radially away from the plate.

2. A method in accordance with claim 1, further comprising retaining at least a portion of the fuel nozzle in an opening defined in the plate, wherein the opening is oriented to channel fuel towards the fuel nozzle.

3. A method in accordance with claim 1, further comprising coupling an air baffle to the plate.

4. A method in accordance with claim 1, further comprising coupling a cap assembly to the plate.

5. A fuel injector for use with a combustor including a casing, a fuel plenum extending circumferentially about the casing, a burner tube coupled to the casing, and a fuel nozzle extending substantially axially through the casing, said fuel injector comprising:

a plate within the casing and coupled to the burner tube, wherein said plate extends generally radially from the fuel plenum to the fuel nozzle;

cantileverly supporting the fuel nozzle with the plate;

a plurality of fuel injection pegs coupled to said plate, said plurality of fuel injection pegs extending substantially radially between the fuel plenum and the fuel nozzle; and wherein the plurality of fuel injection pegs extend radially away from the plate.

6. A fuel injector in accordance with claim 5, wherein said plurality of fuel injection pegs are integrally formed with said plate.

7. A fuel injector in accordance with claim 5, wherein said plate comprises an opening that is oriented to supply fuel to the fuel nozzle, said opening sized to retain at least a portion of the fuel nozzle.

8. A fuel injector in accordance with claim 5, wherein said plate comprises an opening that is oriented such that said plate cantileverly supports the fuel nozzle.

9. A fuel injector in accordance with claim 5, wherein said plate further comprises a first opening disposed substantially in a center of said plate and a plurality of second openings positioned substantially radially about said first opening.

10. A combustor for use with a turbine engine, said combustor comprising:

a casing;

a burner tube coupled to said casing;

a fuel plenum coupled circumferentially about said casing;

a fuel nozzle extending substantially axially through said casing and at partially into said burner tube;

a fuel injector comprising a plate and a plurality of fuel injection pegs coupled to said plate, said plate located within the casing and coupled to said burner tube and extending generally radially from the fuel plenum to the fuel nozzle, said plurality of fuel injection pegs extending substantially radially between said fuel plenum and said fuel nozzle;

cantileverly supporting the fuel nozzle with the plate; and wherein the plurality of fuel injection pegs extend radially away from the plate.

11. A combustor in accordance with claim 10, wherein said plurality of fuel injection pegs are integrally formed with said plate.

12. A combustor in accordance with claim 10, wherein said plate comprises an opening that is oriented to supply fuel to said fuel nozzle, said opening sized to retain at least a portion of said fuel nozzle.

13. A combustor in accordance with claim 10, wherein said plate further comprises an opening that is oriented such that said plate cantileverly supports said fuel nozzle.

14. A combustor in accordance with claim 10, wherein said plate further comprises a first opening disposed substantially in a center of said plate and a plurality of second openings positioned substantially radially about said first opening.

15. A combustor in accordance with claim 10, further comprising an air baffle that is coupled to said plate.

16. A combustor in accordance with claim 10, further comprising a cap assembly that is coupled to said plate.

* * * * *